United States Patent [19]

George

[11] Patent Number: 4,909,148

[45] Date of Patent: Mar. 20, 1990

[54] DROP-IN PRINT STATION FOR MULTI-COLOR PRINTING PRESS

[75] Inventor: John W. George, Meriden, Kans.

[73] Assignee: Express Flexographic Equipment Co., Inc., Topeka, Kans.

[21] Appl. No.: 207,513

[22] Filed: Jun. 16, 1988

[51] Int. Cl.[4] ..... B41F 5/18; B41F 13/26

[52] U.S. Cl. ..... 101/178; 101/224

[58] Field of Search ..... 101/178, 181, 180, 247, 101/351, 352, 224, 226, 227, 209, 207–208, 216, 219

[56] References Cited

U.S. PATENT DOCUMENTS

| | | | |
|---|---|---|---|
| 1,368,258 | 2/1921 | Holtham | 101/219 X |
| 2,690,121 | 9/1954 | Auerbacher | 101/181 |
| 3,068,788 | 12/1962 | Bell et al. | 101/226 |
| 3,223,028 | 12/1965 | Brigham | 101/40 |
| 3,598,050 | 8/1971 | Thompson | 101/375 |
| 3,783,783 | 1/1974 | Hamisch, Sr. | 101/226 |
| 4,111,120 | 9/1978 | Paulson | 101/175 |
| 4,421,027 | 12/1983 | Fischer | 101/352 |
| 4,438,696 | 3/1987 | George et al. | 101/180 |

*Primary Examiner*—J. Reed Fisher

*Attorney, Agent, or Firm*—Hovey, Williams, Timmons & Collins

[57] ABSTRACT

A removable print station has opposed, outwardly extending support portions configured for complemental reception within existing die cutter slots of a press frame. The drop-in printing station includes a plate cylinder which cooperates with an anvil roller associated with the removed die cutting unit for establishing an image on the web passing therebetween. Once the printing station is secured in place, precise lateral adjustment of the position occupied by the printing cylinder, an anilox roller and a doctor roller may be effected as desired.

10 Claims, 2 Drawing Sheets

DROP-IN PRINT STATION FOR MULTI-COLOR PRINTING PRESS

BACKGROUND OF THE INVENTION

1. Field of the Invention

This invention relates to a removable press printing module and is especially adapted for increasing the color capabilities of an existing, multi-color press.

2. Description of the Prior Art

Multi-color web printing presses, and particularly multi-color flexographic presses, rotary letter presses, and gravure presses have a large, central impression cylinder with a number of printing units positioned around the periphery of the impression cylinder. As the web is guided for movement around the impression cylinder, areas of the web sequentially come into contact with the plate cylinders associated with each printing unit. Each plate cylinder is supplied with ink of a color different than the color of ink supplied to the remaining plate cylinders so that the desired, multi-colored composite image is formed as the web continues its path of travel around the impression cylinder.

Other types of multi-color web printing presses are constructed with an inline format wherein a number of printing units or stations along with a number of impression cylinders are arranged along a straight line. Each printing station cooperates with a corresponding impression cylinder to form the multi-color image on the web. Typically, the web travels over each impression cylinder and then downwardly along a path around idler rollers before returning in an upwardly direction to the next impression cylinder in order to provide room for drying of each image before the latter reaches the next printing station.

The flexographic, rotary letter press and gravure processes are well suited for printing large areas of solid, brillant colors, and as such are used extensively in the printing of labels as well as many types of packaging materials. In conventional presses of this type, die cutting units removably mounted in slots of the press frame are positioned downstream of the impression cylinder for cutting or forming the web as needed before delivery to the end user.

In general, most common small flexographic presses have three printing units so that a three color image can be produced on the web. However, it is often desired, especially for labels, that images of four or more colors be provided in order to increase the attractiveness of the labels and enhance consumer appeal.

Those printers with inline presses, whether flexographic, rotary letter press or gravure utilizing up to six or more color stations are often faced with the need to add even more colors or a varnish coat to meet customer requirements. In some cases, it may be desirable to mix processes on a particular job for reasons of quality or ease of production. For example, it is generally accepted that varnish is easier to apply flexographically than by rotary letter press. It might, therefore, be advantageous to add a flexographic print station after all the letter press stations have printed.

While add-on printing stations for multi-color presses have been utilized in the past, as a general rule such add-on units are somewhat difficult to install and remove as needed. In this regard, it is sometimes necessary to frequently change the travel of the web and particularly the die cutting units to produce, for a limited time, labels and other printed objects of a particular configuration.

SUMMARY OF THE INVENTION

In view of the foregoing, one important object of the present invention is to provide a drop-in print station which can be readily installed in and quickly removed from many different types of multicolor presses. In this regard, it is also significant and important that the drop-in print station of the present invention can be retrofitted to existing presses already in the field without any modification to the basic supporting frame of the press or its printing mechanism. The color capabilities of the press are thereby increased when needed in order to create images comprised of more than the number of colors standard to that particular press.

A further important object of the present invention is to provide an add-on or drop-in print station which successfully overcomes the severe space limitations confronting such a station when the station is one which is placed between the two sidewalls of the press. In other words, by designing the add-on station of the present invention in such a way that it slips down into the press, between its existing sidewalls, the available working width for the cylinders, drive mechanisms, and ink supply is significantly compromised. Accordingly, it is important that the present invention provide a way of dealing with such space constraints while obtaining the benefits of the drop-in design.

As will become apparent from the detailed description which follows later in this specification, the principles of the present invention are not limited to any one particular type of press, but instead may be utilized beneficially in flexographic presses, rotary letter presses and gravure presses, whether they be of the central impression, in-line or stack type.

In more detail, the drop-in print station of the present invention includes a subframe having opposed, outwardly projecting support portions which are complementally received within upright die cutting station slots of the press. Existing presses are often provided with two or more pairs of open ended, vertical slots for reception of a die cutting unit in any one pair of slots as desired. Thus, the drop-in print station can be quickly installed in an upstream pair of slots while the die cutter, if needed, can be located downstream and mounted in another pair of slots. When not in use, the print station can be readily removed and the die cutter immediately replaced, if desired, in the upstream pair of slots.

In accordance with the invention, a threaded clamping member secures the subframe to the press frame with the support portions of the subframe received in respective slots. Each support portion includes two spaced-apart plates, and mounting structure for the plate cylinder of the print station is movable in either direction along the length of the slot in order to vary the pressure of the plate roller against the web and the base roller therebelow. Two upright, threaded rods retain the plate cylinder mounting structure in the selected position along the length of the slots.

DETAILED DESCRIPTION OF THE DRAWINGS

As earlier mentioned, the principles of the present invention are not limited to any single particular type of press, although in some respects they have particular utility in connection with central impression, flexographic presses. By way of example and in the interest of brevity, the drawings and description which follow are directed toward a central impression, flexographic press.

Figure 1:
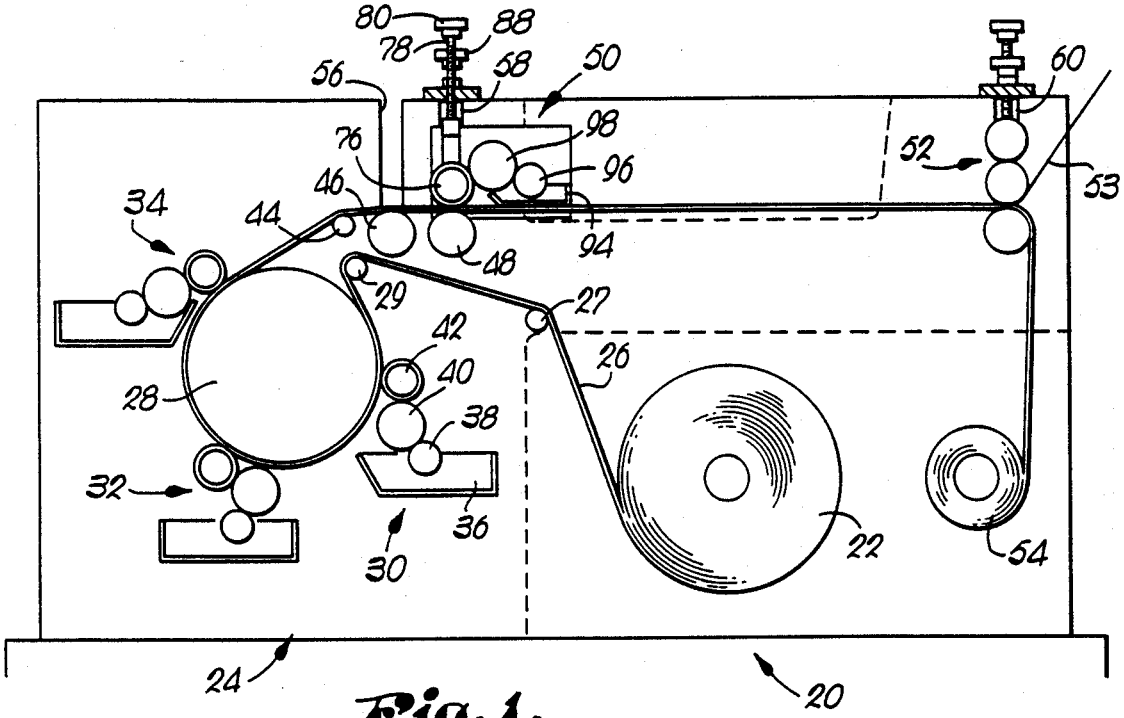
FIG. 1 is an essentially schematic, side elevational view of a central impression flexographic printing press along with a drop-in print station constructed in accordance with one embodiment of the present invention.

A printing press is designated broadly by the numeral 20 in FIG. 1 and, in the particular construction shown, is a central impression press with a web supply reel 22 carried by a press frame 24. An elongated web 26 extends from the supply reel 22 and around two idler rollers 27, 29 for engagement with a portion of a central, relatively large impression cylinder 28.

The press 20 has three printing units 30, 32, 34 which each print an image of a different color on selected areas of the web 26. The printing unit 30 is comprised of an ink tray 36 that receives and stores a quantity of ink of a particular color. A doctor roller 38 of the printing unit 30 is positioned to transfer ink from the tray 36 and onto an anilox roller 40 which, in turn, transfers ink to the plate cylinder 42. The printer units 34, 36 have essentially similar components and thus need not be described in further detail.

The web 26, after disengaging the impression cylinder 28, travels around another idler roller 44 and then over a pair of anvil or base rollers 46, 48. A drop-in print station 50, described in further detail below, is positioned above the base roller 48. The web 26 then advances toward a die cutting unit 52 where, for example, a trimmed margin 53 is formed and subsequently stripped away from the remaining portions of the web 26 which advance in a downwardly direction to a take-up reel 54.

The press frame 24 has structure defining three pairs of spaced apart slots 56, 58, 60 located on opposite sides of the press 20. Slots of these type are often provided in conventional presses for enabling installation or removal of a die cutting unit such as unit 52. By providing more than one pair of such slots, additional die cutting units may be utilized or a single die cutting unit may be located either closely adjacent or somewhat further away from the impression cylinder 28 as desired in accordance with the type of work operation.

As illustrated for exemplary purposes in the drawings, the drop-in printing station 50 is removably mounted in slot 58 above base roller 48. The printing station 50 has a subframe 62 as perhaps shown best in FIGS. 2, 3, 5 and 7, and the subframe 62 is comprised of two parallel, spaced apart side assemblies 64, 66 (see, e.g., FIGS. 5 and 7) located adjacent opposite sides of the press frame 24. An elongated, square-in-cross-section bar 68 interconnects sides assemblies 64, 66.

Opposite ends of the bar 68 are secured to subframe support portions which are comprised of a pair of elongated, parallel plates 70. The pair of plates 70 affixed to each end of the bar 68 are spaced apart from each other a distance complemental to the width of slot 58 (as well as slots 56, 60) for sliding reception in the latter. A plate cylinder mounting bracket 74 (FIGS. 2, 3 and 7) is slidable along guide means or keys 72 fixed to plates 70 within the elongated space or channel between each pair of plates 70, and the bracket 74 is connected to a shaft 75 which extends through both of the slots 58.

As is conventional, a plate cylinder 76 is rotatably carried by shaft 75 and has a bore that removably receives the shaft 75. When, for instance, it is desired to remove the plate cylinder 76 from the drop-in printing station 50, a springloaded pin 77 (FIG. 7) of a conventional retaining assembly is depressed to release shaft 75, whereupon the operator may grasp a knob 79 (FIG. 7) in order to pull the shaft 75 through the slots 58 and thereafter permit the plate cylinder 76 to be lifted transversely out of the press and replaced with a different plate cylinder.

A pair of threaded adjustment members 78 are rotatably connected to bracket 74 and extend through complementally threaded apertures formed within respective end portions of the bar 68. Each adjustment member 78 extends vertically above the press frame 24 and terminates in a knob 80 (FIG. 1) which thus can be manually turned as desired to shift the mounting bracket 74 and thereby the plate cylinder 76 in upward or downward directions in order to vary the pressure of the plate cylinder 76 against the web 26 and the base roller 48 therebelow.

Figure 2:
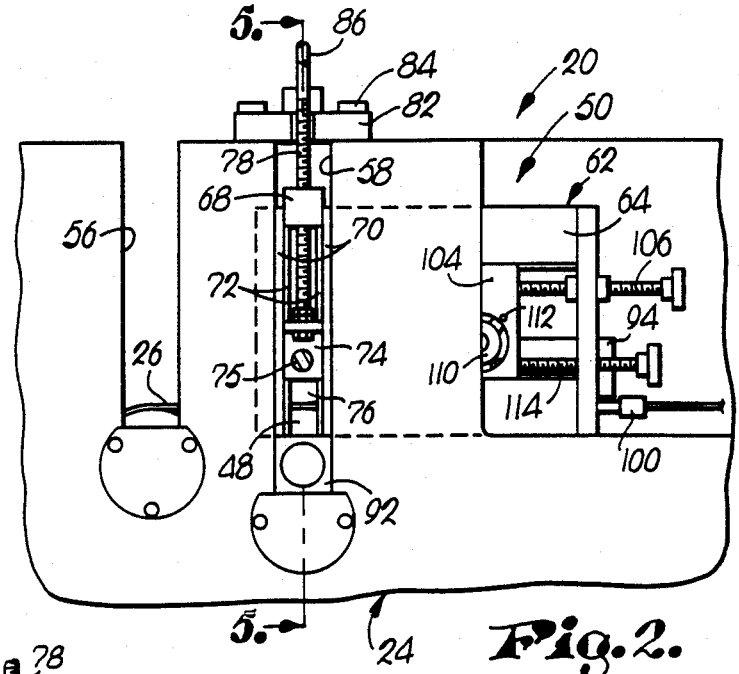
FIG. 2 is an enlarged, fragmentary, side elevational view of the drop-in print station and a portion of the press depicted in FIG. 1.
Figure 7:
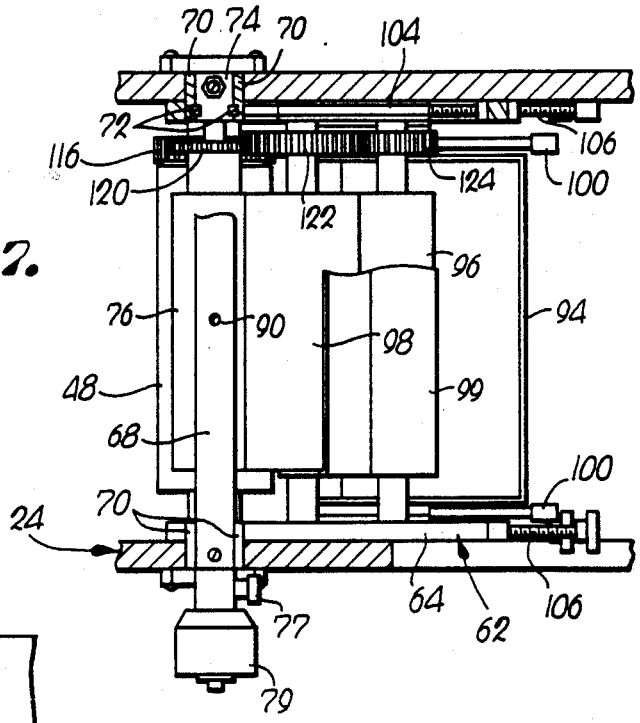
FIG. 7 is an enlarged, fragmentary, horizontal sectional view of the press and drop-in print station shown in FIGS. 1, 2 and 5.
Figure 8:
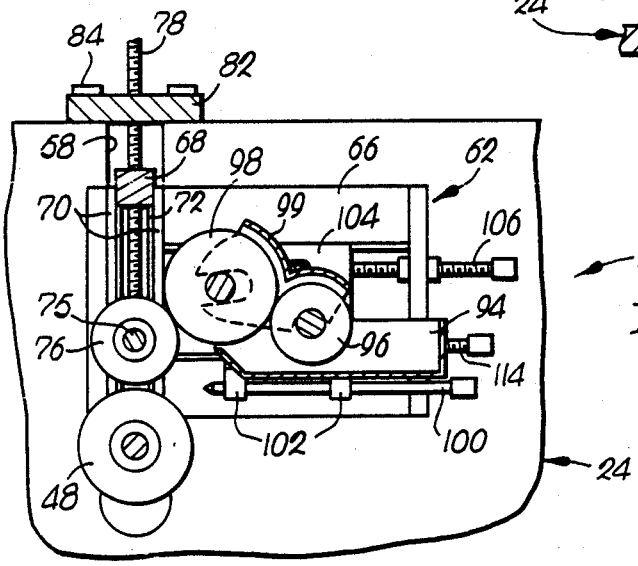
FIG. 8 is an enlarged, fragmentary, side cross-sectional view of the press and print station shown in FIGS. 1, 2, 5 and 7, illustrating the rollers and ink tray of the print station.

The subframe 62 of the drop-in printing station 50 is secured in place on the press frame 24 by means of an elongated element 82 that is removably affixed to upper side edges of the frame 24 by bolts 84 (FIGS. 2 and 8). An elongated, upright threaded adjustment member 86 has an upper end which is fixed to a knob 88 (FIG. 1) and the member 86 extends through a complementally threaded bore within the horizontal element 82 for engagement with a top side of the bar 78. As shown in FIG. 7, the bar 68 is provided with a slight, concave indention 90 for reception of the lower end of member 86.

Thus, in accordance with the invention, the printing station 50 may be readily installed on frame 24 by lowering the station 50 in such a manner that the support portions comprising plates 70 are received in respective slots 58. The station 50 is lowered until the lower end of the plates 70 comes into contact with the upper, flat wall of a mounting block 92 (FIGS. 2 and 5) rotatably supporting the base roller 48. Next, element 82 is secured to the upper side of frame 24 by means of bolts 84, and the threaded adjustment member 86 is tightened until the lower end thereof bears against the bar 68 to firmly seat the station 50 in place.

The drop-in printing station 50 also includes a source of ink which comprises an ink tray 94. A doctor roller 96 and an anilox roller 98 together comprise a means for transferring ink from the tray 94 to the plate cylinder 76. Upper portions of the rollers 96, 98 are partially covered by a shield 99 which can be best observed in FIGS. 7 and 8.

The ink tray 94 is secured in place between the side assemblies 64, 66 of the subframe 62 by means of a slidable pin 100 which is removably inserted within apertures of lugs 102 affixed to assemblies 64, 66. The ink tray 94 has opposed, outwardly extending plate portions (not shown in detail) which are received between the spaced apart lugs 102 and above the pin 100 for retaining the tray 94 in position.

Figure 3:
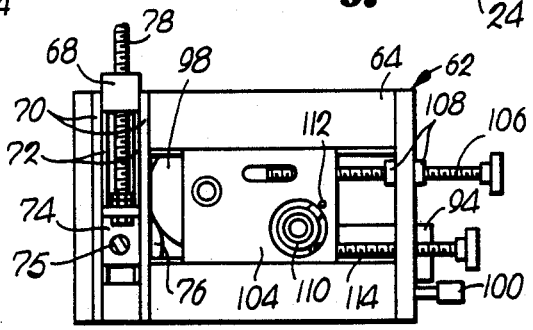
FIG. 3 is an enlarged, fragmentary, side elevational view of the drop-in print station alone which is shown in FIG. 2.

The doctor roller 96 and the anilox roller 98 are both rotatably carried on opposite sides by a flat block 104 that is slidable along keyways within an opening of the respective side assemblies 64, 66. Referring, for example, to FIG. 3, the position of the block 104 within the opening of side assembly 66 is determined by the rotational orientation of an elongated, threaded rod 106 that is releasably secured in place to an upright member of the side assembly 66 by means of opposed lock nuts 108. The rod 106 is also rotatably coupled to the block 104 such that rotation of the outer end of rod 106 shifts the block 104 in a horizontal direction for movement of the anilox roller 98 (and the doctor roller 96) either toward or away from the plate cylinder 76.

The doctor roller 96 is rotatably carried by a pair of supports 110 (FIGS. 2 and 3) received within a circular aperture formed in each block 104. The supports 110 are mounted for swinging movement about a pivot 112, and the position of the support 110 is selected by adjustment of a threaded rod 114 that bears against a lower portion of the support 110 and is received in a complementally threaded hole of the block 104. The pressure of the doctor roller 96 against the anilox roller 98 may therefore be varied by axial rotation of rod 114.

Figure 5:
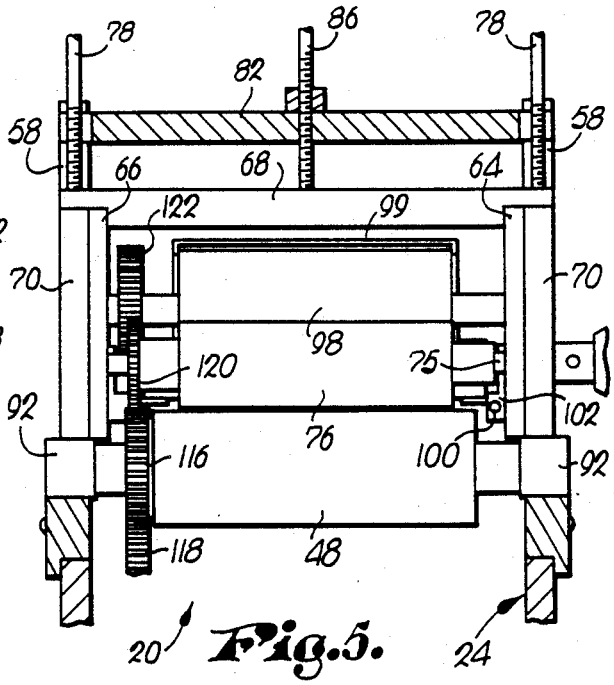
FIG. 5 is an enlarged, fragmentary, end cross-sectional view of the press and drop-in print station taken along line 5—5 of FIG. 2.

As shown in FIGS. 5 and 7, one end of the base roller 48 is provided with a gear 116 which is driven by a gear 118 of a drive unit (not shown) of the press 20. Once the print station 50 is lowered in place, the gear 116 of the base roller 48 comes into meshing engagement with a gear 120 that is fixedly connected to the plate cylinder 76. The gear 120 also meshes with a gear 122 that is fixedly coupled to the anilox roller 98, and in turn the gear 122 drives a gear 124 fixedly mounted on one end of the doctor roller 96 such that, in effect, the base roller 48 provides rotational power for all of the rollers of the drop-in printing station 50 once the latter is installed on the press 20.

Figure 4:
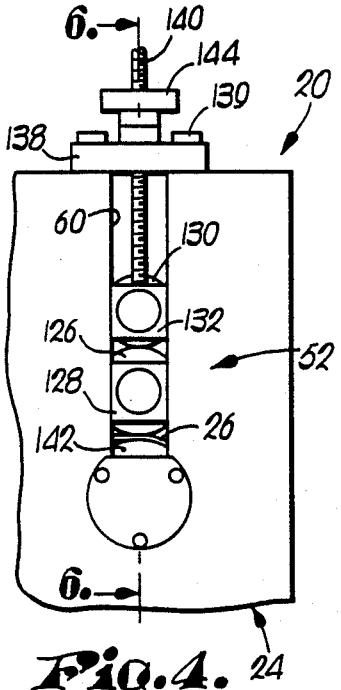
FIG. 4 is an enlarged, fragmentary, side elevational view of a die cutting unit of the press shown in FIG. 1.
Figure 6:
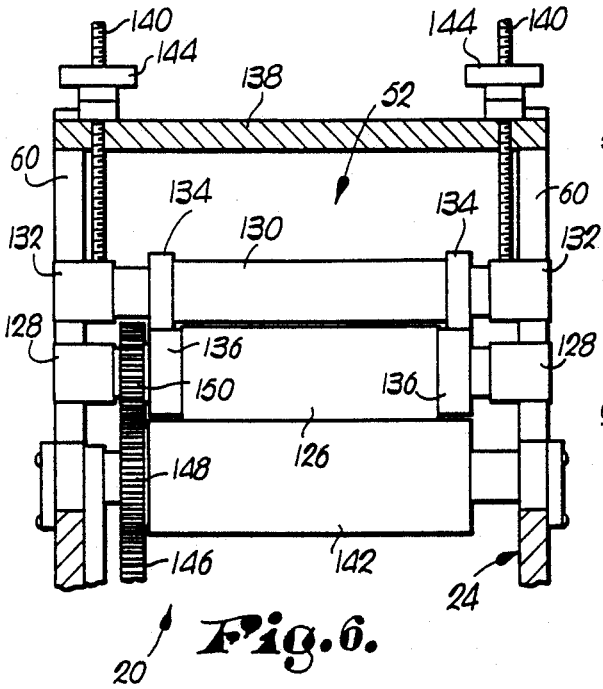
FIG. 6 is an enlarged, fragmentary, side cross-sectional view of the press and die cutter unit taken along line 6—6 of FIG. 4.

The die cutting unit 52 shown in FIGS. 4 and 6 is illustrated in connection with slots other than those utilized for the drop-in print station 50. Thus, while the description which follows takes into account such remote positioning of the die cutting unit 52, it is to be understood that the present invention contemplates substituting the print station 50 for the die cutting unit 52, and vice versa, using the same receiving slots if such is desired. In other words, the die cutting unit 52 and the print station 50 are interchangeable without modifying the press structure itself.

The die cutting unit 52 is shown in more detail in FIGS. 4 and 6 and conventionally includes a die roller 126 supported on opposite ends by support portions or mounting blocks 128. A pressure roller 130 is disposed above the die roller 126 and is carried on opposite ends by support portions or mounting blocks 132. The blocks 128, 132 are all received within the slot 60 formed in the press frame 24, although as is conventional with units of this type, the rollers 126, 130 and their associated mounting blocks 128, 132 are separate components installed in sequence, and are not interconnected by a common framework for simultaneous reception within slots 60.

As shown in FIG. 6, the pressure roller 130 has enlarged, spaced apart cylindrical portions 134 which bear against recessed cylindrical portions 136 formed in the die roller 126. An elongated plate 138, connected by bolts 139 to threaded holes formed on opposite sides of the press frame 24, has threaded apertures which receive vertically extending threaded rods 140 that are fixed at their upper ends to a knob (not shown); lock nuts 144 are received on each rod 140 for releasably fixing the latter in place.

The pressure of the die cutting roller 126 against an anvil or base roller 142 therebelow is maintained by the pressure roller 130. The anvil roller 142 may conveniently be the same roller as the anvil roller 48 used with the drop-in print station 50. The force of the die cutting roller 126 against the base roller 142 can therefore be varied as needed by adjustment of the threaded rods 140 which effect lateral shifting of the pressure roller 130 to increase or decrease the pressure exerted by the cylindrical portion 134 against the portions 136. As is illustrated in FIG. 6, the die cutting unit 52 is driven by a gear 146 of the drive unit of press 20 (which may be the same gear as the gear 118 illustrated in FIG. 5 for the drop-in press station 50) which is in meshing contact with a gear 148 secured to the base roller 142 (the gear 148 may likewise be the gear 116 of anvil roller 48 in the event the same anvil roller is used for both the print station 50 and the die cutting unit 52). The gear 148 meshingly contacts a gear 150 that is connected to the die cutting roller 126 for rotation of the latter.

Importantly, support for the roller 76 including bracket 74 and plates 70, is achieved by structure which is received within the slots 58 as opposed, for instance, to structure which is disposed inboard of the upright sidewalls of the press frame 24. In this manner, the plate cylinder 76 can be adequately supported while remaining rollers including rollers 96, 98 may be supported solely by the subframe 62 with its side assemblies 64,66. Further, space constraints are particularly severe for the drop-in station 50, and locating the verticle adjusting means for the plate cylinder 76, i.e., the keys 72, within slots 58 instead of inboard of the sidewalls of the press frame 24 permits the rest of the drop-in station 50 to fit neatly within and between the sidewalls without sacrificing print quality or efficiency.

As can now be appreciated, the drop-in printing station 50 of the present invention represents an especially effective means for increasing the color capabilities of the press 20 without any modification of the frame 24. The printing station 50 is a self-contained unit, and the nip pressures between the plate cylinder 76, the doctor roller 96 and the anilox roller 98 need not be disturbed if, for instance, it is desired to temporarily remove the station 50 from the press frame 24. On the other hand, installation of the station 50 is particularly a simple matter in that the subframe 62 need merely be cinched down by the threaded member 86 once the element 82 is in place. In this regard, the bolts 139 are identical to bolts 84 and thus represent a means for selectively retaining either the die cutting unit 52 or the printing station 50 on the press frame 24 with support portions (blocks 128, 132) of the die cutting unit 52 or alternatively the support portions (plate 70) of the printing station 50 in disposition within the respective slots 58. To this end, the width of the blocks 128, 132 is equal to the outer width presented by plates 70 and is complemental in width to the width of slots 58.

Another particular advantage of the present invention is the utilization of the anvil roller 48 as an impression cylinder for the printing station 50. Moreover, the laterally offset orientation of the rollers 96, 98 enables the nip between the latter to be disposed in overlying relation to the ink tray 94 in order to catch drips of excess ink.

The foregoing represents for exemplary purposes only a detailed description of my present invention when used in cooperation with a central impression printing press. However, the present invention is equally effective for use with inline presses as well. Moreover, those skilled in the art may recognize that many modifications or additions may be effected to the embodiment described hereinabove. Accordingly, the invention should be deemed limited only by a fair scope of the claims which follow along with their mechanical equivalents thereof.

I claim:

1. A printing press comprising:

frame means including structure defining a pair of elongated, spaced apart slots;

web conveying apparatus for advancing a web along a path of travel including a portion adjacent the space between said slots;

a first roller rotatably carried by said frame means for contact with the web at a location adjacent the space between said slots; and a print station including— a subframe, means for detachably securing said subframe to said frame means, a plate roller, plate roller support means for supporting said plate roller on said subframe, said support means including shifting means for selectively shifting said plate roller relative to said frame means in a direction generally along the length of said slots for moving said plate roller either toward or away from said first roller, and an inker assembly carried by said subframe and disposed adjacent said plate roller and including an ink source and means for transferring ink from said source to said plate roller.

2. The invention as set forth in claim 1, wherein said shifting means includes guide means extending in a direction substantially parallel to the longitudinal axis of said slots.

3. The invention as set forth in claim 1, wherein said structure defining said pair of slots includes a wall defining the bottom of said slots, and wherein said subframe includes a pair of opposed, outwardly extending, elongated support portions each removably received in a respective one of said slots, each of said support portions including means in supporting, abutting contact with said bottom wall of each of said slots for supporting said print station.

4. The invention as set forth in claim 3, wherein said support portions each include a pair of elongated, spaced apart plates defining a channel therebetween, and wherein said plates each have an inner surface for guiding the movement of said plate roller along the length of said slots.

5. The invention as set forth in claim 1, wherein said support means includes a shaft extending into both of said slots and movable on a longitudinal direction through said slots in order to move said plate roller toward and away from said first roller.

6. The invention as set forth in claim 1; and including means for selectively moving said inker assembly toward or away from said plate roller.

7. The invention as set forth in claim 1, wherein said subframe includes an elongated bar extending horizontally between said slots, and wherein said means for securing said subframe to said frame means includes an elongated element removably connected to said frame means and extending in directions generally parallel to the longitudinal axis of said bar, and a threaded adjustment member extending between said elongated element and said elongated bar.

8. The printing press as set forth in claim 3, further comprising a die cutting station including a pair of opposed, outwardly extending support portions of a width complemental to said width of said slots; and means for selectively, releasably retaining either one of said die cutting station and said print station on said frame means with the corresponding support portions of said die cutting station or said print station in disposition extending into said slots.

9. In a printing apparatus, the improvement comprising:

a pair of laterally spaced apart sidewalls, each having an upright slot disposed in transversely aligned relationship with the corresponding slot of the other sidewall;

an anvil roller spanning said sidewalls and supported adjacent the bottom of said slots;

a plurality of die cutting rolls adapted for supporting reception within said slots to span the sidewalls and cooperate with the anvil roller in performing die cutting functions;

a print station interchangeable with said die cutting rolls and including a subframe and a plate roller and inker assembly supported by said subframe, said subframe having laterally outwardly projecting support structures configured to be complementally received within said slots to position the plate roller in spanning relationship to the sidewallls and in operating relationship with the anvil roller for performing printing functions; and means for selectively, releasably retaining either said die cutting rolls or the print station within said slots to permit selective interchangeability of the die cutting rolls and the print station, said anvil roller being adapted to operate as an impression roller when said print station is retained within said slots and as an anvil roller when said die cutting rolls are retained in said slots.

10. A drop-in print station for use with a printing press having a pair of upright sidewalls provided with a pair of transversely aligned, upright and upwardly opening support slots, said press further having a transverse base roll located adjacent the bottom of said slots and a drive gear at one end of the base roll, said drop-in print station comprising:

a subframe adapted to be inserted between said sidewalls of the press when the station is installed;

rigid locating structure projecting laterally outwardly from opposite sides of said subframe in disposition for complemental reception within said slots when the station is installed between the sidewalls;

means for detachably securing said locating structure within said slots when the station is installed on the press;

a plate roll supported by said subframe in disposition for cooperating with said base roll to perform a printing function when the station is installed on the press; and an inker assembly carried by said subframe in position for transferring ink to said plate roller to perform said printing function when the station is installed on the press.

* * * * *